US005499482A

United States Patent [19]

Goff

[11] Patent Number: 5,499,482

[45] Date of Patent: Mar. 19, 1996

[54] STRUCTURE AND METHOD FOR ENCAPSULATING AN EXISTING BUILDING

[75] Inventor: Todd A. Goff, Topeka, Kans.

[73] Assignee: PTMW, Incorporated, Topeka, Kans.

[21] Appl. No.: 102,847

[22] Filed: Aug. 6, 1993

[51] Int. Cl.[6] ..... E04G 23/00; E02D 27/48

[52] U.S. Cl. ..... 52/742.13; 52/169.9; 52/265; 52/299; 52/741.1; 52/741.3; 405/230

[58] Field of Search ..... 52/741.1, 741.3, 52/742, 745.02, 274, 299, 169.9, 79.1, 3, 4, 127.2, 265, 269, 743; 405/229, 230

[56] References Cited

U.S. PATENT DOCUMENTS 960,207 5/1910 Slater ..... 52/299

3,771,273 11/1973 Brodie ..... 52/169.9

*Primary Examiner*—Michael Safavi

*Attorney, Agent, or Firm*—Shook, Hardy & Bacon

[57] ABSTRACT

A structure for encapsulating an existing building includes an underpinning system for mounting on the existing building. The underpinning system includes a perimeter frame assembly with side and end rails, outrigger assemblies mounted on the side rails and scissor jack assemblies mounted on the end rails. A shell system is mounted on the perimeter frame assembly and includes side walls, end walls and a roof. Door assemblies are installed in the end walls. A method of encapsulating an existing building includes the steps of providing an underpinning system, fastening the underpinning system to the existing building, providing a shell system with side walls, end walls, a roof and an open bottom, and receiving the existing building through the shell system open bottom for placing the shell system in covering relation over the existing building. The encapsulating method further includes the steps of fastening the shell system to the underpinning system and injecting insulating foam into an interstitial space formed between the shell system and the existing building.

25 Claims, 5 Drawing Sheets

Fig. 5.
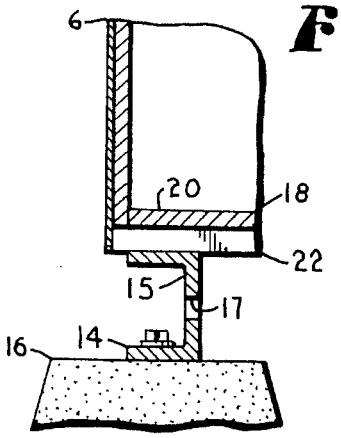
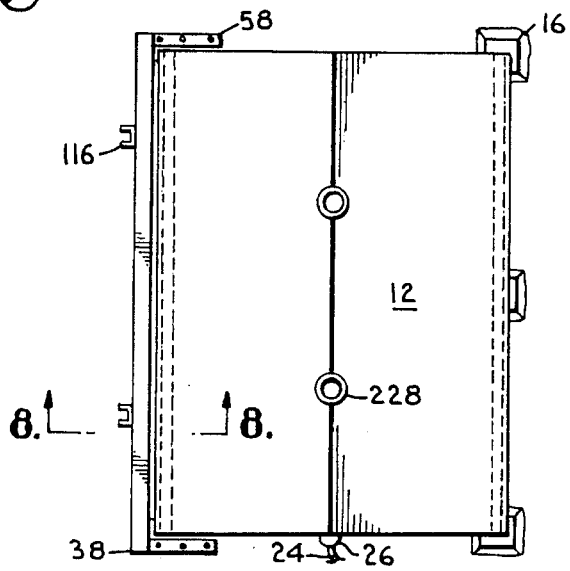
Fig. 7.
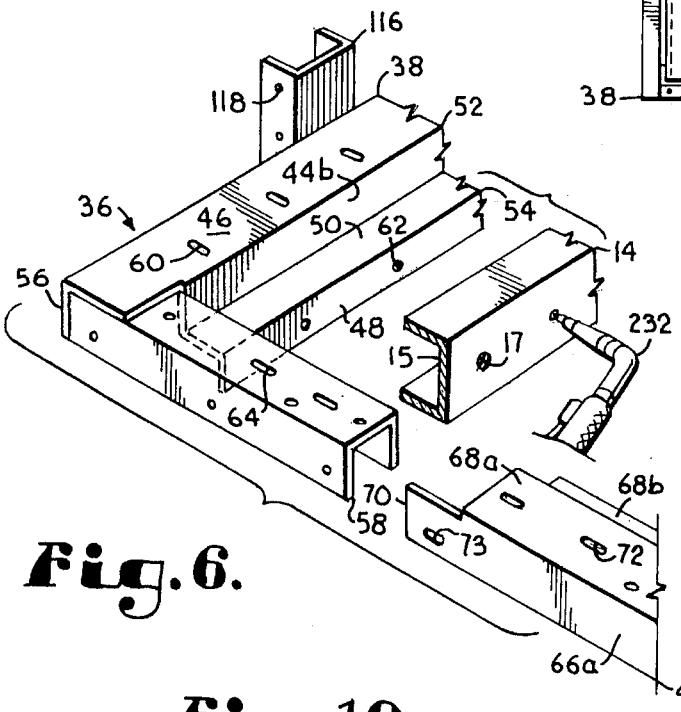
Fig. 6.
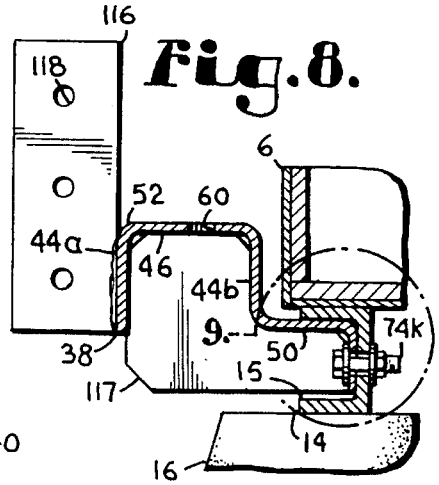
Fig. 8.
Fig. 10.
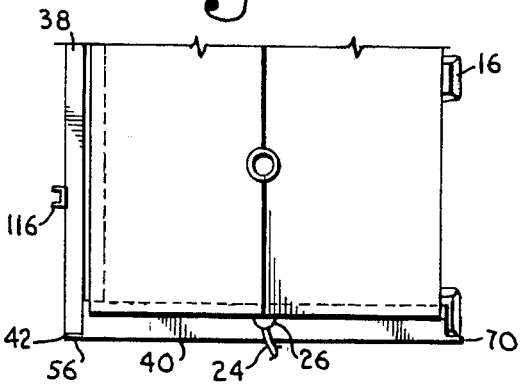
Fig. 9.
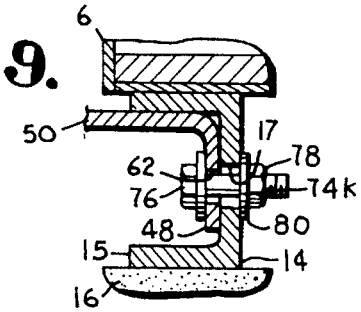

Fig.10a.
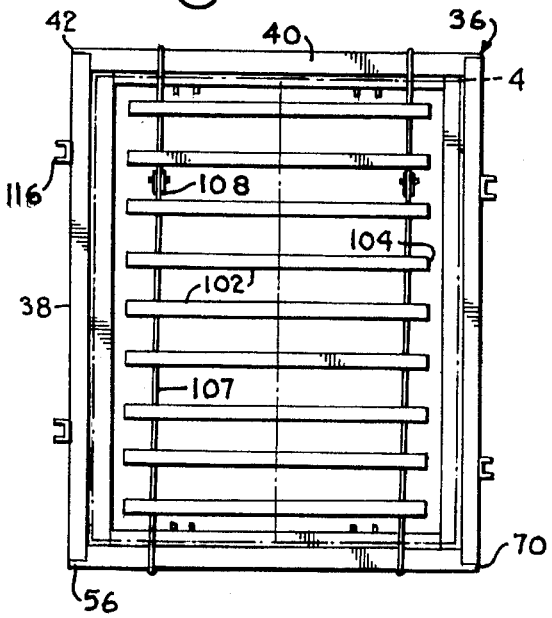
Fig.12.
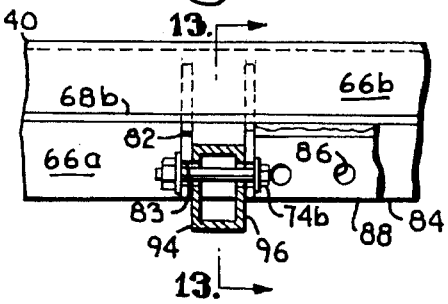
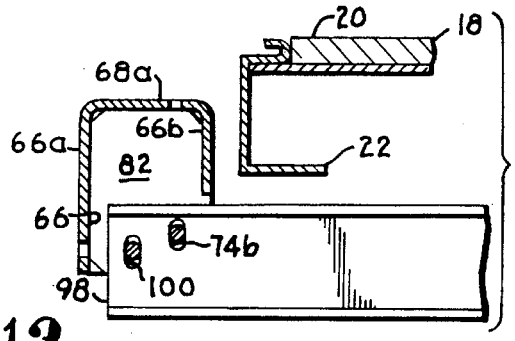
Fig.13.
Fig.11.
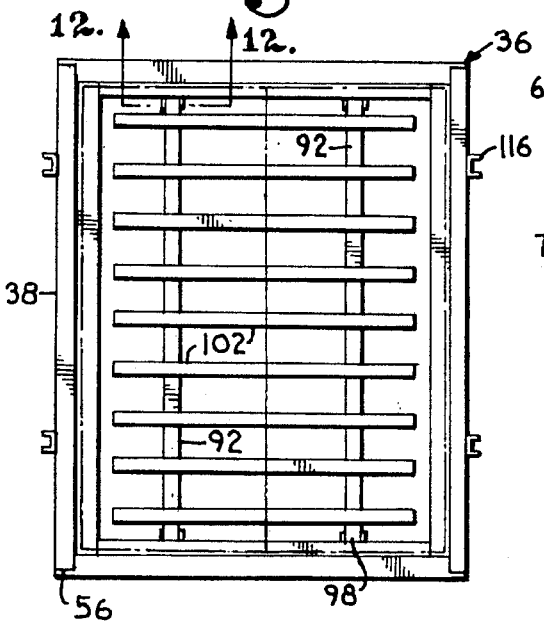
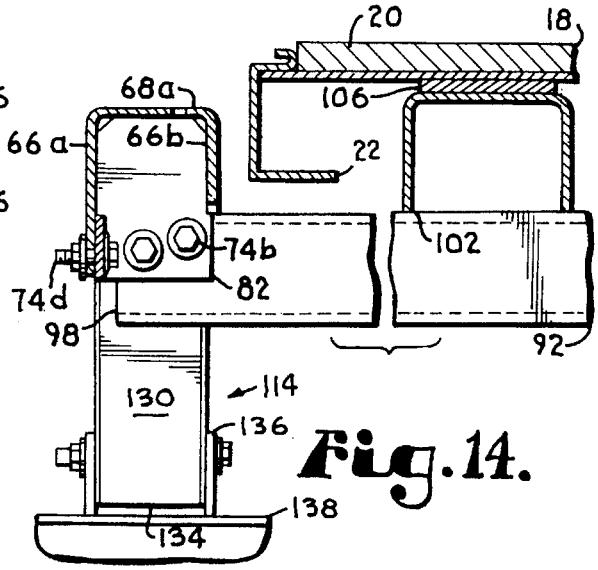
Fig.14.

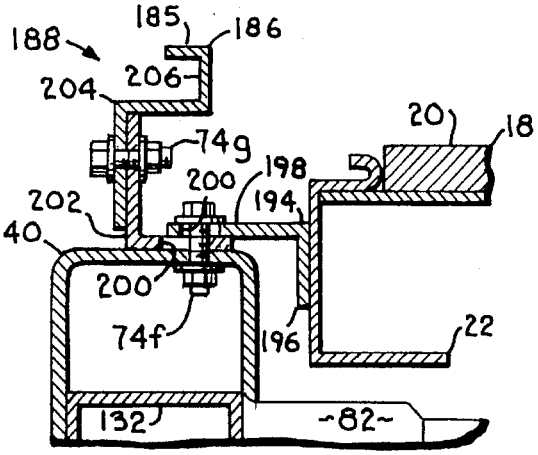
Fig. 16.
Fig. 15.
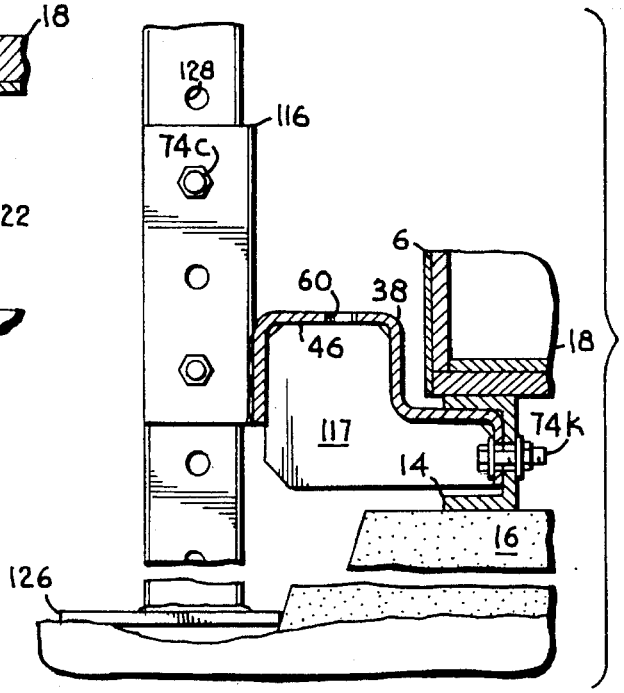
Fig. 17.
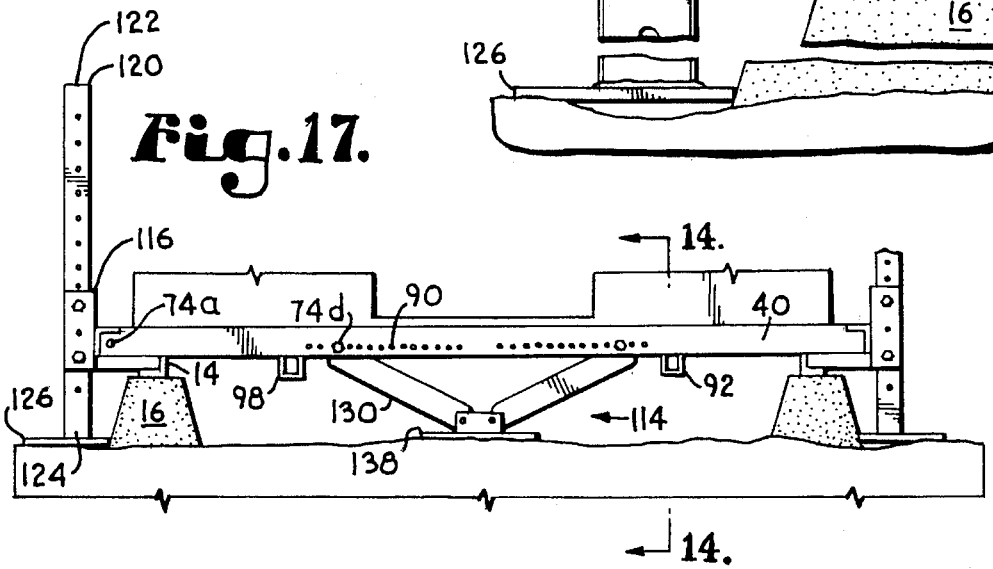
Fig. 19.
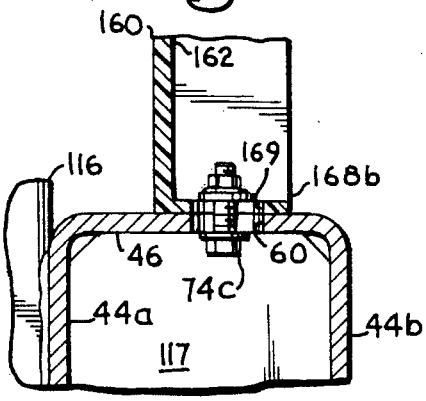
Fig. 20.
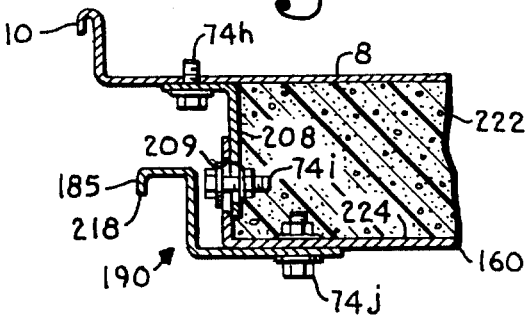

STRUCTURE AND METHOD FOR ENCAPSULATING AN EXISTING BUILDING

BACKGROUND OF THE INVENTION

1. Field of the Invention

This invention relates generally to buildings, and in particular to a structure and method for encapsulating an existing building by installing an underpinning system thereunder and placing a shell system thereover.

2. Description of the Related Art

Various types of buildings have heretofore been proposed for creating enclosed, sheltered spaces for a wide variety of purposes. For example, habitable structures are designed to shelter their occupants and accommodate their indoor activities, such as working, eating, sleeping, etc.

Uninhabited structures are commonly used to house equipment and can be designed to protect equipment enclosed therein from certain ambient conditions, such as precipitation, solar insolation, etc. The temperature within such uninhabited structures can either be controlled or permitted to vary according to the ambient temperature, depending upon the requirements of the equipment sheltered therein. For example, certain types of equipment operate satisfactorily in a wide range of ambient temperatures and can thus be enclosed in buildings which are not heated or cooled. Structures which enclose equipment also provide security and protection therefor, and can provide safety by shielding unauthorized persons from dangerous equipment and machinery.

Various exterior building materials have previously been employed for withstanding and repelling ambient environmental conditions. However, many types of external building materials tend to weather and deteriorate due to the effects of prolonged exposure to the elements. Buildings constructed of such materials can require periodic maintenance, such as painting and replacement of deteriorating materials, which tends to increase the life-cycle building costs. There have been many attempts to develop buildings which require little or no maintenance and which are constructed of highly weather-resistant materials.

A relatively common example of an uninhabited building type for housing equipment can be found along many railroad rights-of-way. Switchgear and other electrical and electronic equipment such as transformers, relays, etc. are typically located in such buildings at spaced locations alongside many railroad tracks. Such buildings can be relatively small, for example, approximately six feet wide, approximately eight feet long and approximately eight to ten feet high. Many such buildings are located in relatively remote areas. Due to their remoteness, service calls for inspection and maintenance tend to be relatively expensive and inconvenient. Therefore, railroads and other companies with inventories of equipment buildings in remote locations commonly construct such buildings, to the extent practicable, of relatively low-maintenance materials.

Sheet metal has been a relatively popular choice for the shells of these buildings because it tends to be relatively strong and because sheet metal buildings of this type can be assembled relatively quickly in situ. Moreover, since many of these buildings are not heated or cooled, the relatively high thermal conductivity of steel is generally not considered a particular disadvantage. However, a disadvantage with steel is its susceptibility to rust and corrosion, particularly if left exposed to the elements. Although paint, galvanizing and other coatings can retard such deterioration, relatively harsh environments and relatively infrequent maintenance have resulted in rust and corrosion damage to a number of buildings of this type.

The encapsulating structure and method of the present invention address the aforementioned problems of deterioration and shell damage in existing buildings, particularly such deterioration and damage which are caused or enhanced by exposure to the elements.

SUMMARY OF THE INVENTION

In the practice of the present invention, a structure is provided for encapsulating an existing building and generally comprises an underpinning system and a shell system. The underpinning system includes a perimeter frame assembly comprising side and end rails. The side rails are fastened to the existing building. A foundation subsystem includes outrigger assemblies mounted on the side rails and scissor jack assemblies mounted on the end rails. Floor joists are supported on floor support beams below the floor structure of the existing building for supporting same. The shell system includes side and end walls comprising wall panels mounted on the perimeter frame assembly. Door assemblies are mounted in the end walls and a roof is mounted on top of the walls. An interstitial space between the existing building and the shell system is filled with insulating material, such as polyurethane foam which can be injected through foam inlet ports in the wall panels and in the roof.

In the practice of the method of the present invention, a perimeter frame is mounted on floor support members of an existing building and is adjusted for the size of the existing building. The perimeter frame assembly is supported above a ground surface by a foundation system which is vertically adjusted to extend between the perimeter frame assembly and the ground surface below the extending building. A shell system comprising side walls, end walls and a roof can be preassembled for installation in situ by lowering it over the existing building onto the perimeter frame assembly. An interstitial space is formed between the shell system and the existing building. The method further includes the step of injecting insulating material, such as foam, into the interstitial space. The end walls are provided with door openings which receive door assemblies for adjustable engagement with the existing building to enclose the interstitial space adjacent to the door openings. On the job site, lifting lines are attached to the shell system roof and the shell system is lifted over the existing building by suitable lifting equipment and is lowered in place thereover.

OBJECTS AND ADVANTAGES OF THE INVENTION

The principal objects and advantages of the present invention include: providing a structure for encapsulating an existing building; providing such a structure with an underpinning system adapted for mounting on the existing building; providing such a structure with a shell system adapted for prefabrication remote from the job site and installation in situ; providing such a structure which is size adjustable for accommodating existing buildings of different sizes and configurations; providing such a structure with a foundation subsystem adapted for adjustably extending between a perimeter frame assembly and a ground surface under the existing building; providing such a structure with an underpinning system adapted for supporting an existing floor structure; providing such a structure which provides an interstitial space around the existing building; providing such a structure with insulating material in the interstitial space; providing such a structure which can relatively effectively shield the contents of the existing building from the elements; providing such a structure which can be constructed of relatively common building materials; and providing such a structure which is economical to manufacture, efficient in operation, capable of a long operating life and which requires relatively little maintenance; providing a method of encapsulating an existing building; providing such a method wherein an adjustable underpinning system is adjustably mounted on the existing building; providing such a method which can accommodate various sizes and configurations of existing buildings; providing such a method which effectively and economically encapsulates existing buildings, thus protecting against further environmental damage thereto and deterioration thereof; providing such a method which includes the steps of prefabricating a shell assembly at a location remote from the job site and installing the prefabricated shell system in situ; providing such a method which is relatively economical; providing such a method which requires relatively little time for encapsulating an existing building; providing such a method which includes the step of insulating an interstitial space between the existing building and the prefabricated shell system; and providing such a method which is particularly well-adapted for encapsulating existing buildings which are remotely located; and providing such a method which is particularly well-adapted for encapsulating relatively large numbers of existing buildings which tend to have relatively standard sizes, configurations and components.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is a vertical cross-sectional view of the existing building taken generally along line 5—5 in FIG. 1 and particularly showing an existing channel-section floor support member.

FIG. 6 is a fragmentary, exploded upper perspective view showing a corner of a perimeter frame assembly of the encapsulating structure and also showing receivers being torch-cut in an existing channel-section floor support member.

FIG. 7 is a top plan view of the existing building, shown with a side rail of the perimeter frame assembly mounted thereon.

FIG. 8 is a vertical cross-sectional view taken generally along line 8—8 in FIG. 7 and particularly showing the mounting of a side rail on an existing channel-section floor support member.

FIG. 9 is an enlarged detail of the area generally shown in circle 9 in FIG. 8.

FIG. 10 is a fragmentary top plan view of the existing building, shown with side and end rails of the perimeter frame assembly mounted thereon.

FIG. **10*a*** is a top plan view of the underpinning system of the encapsulating structure, shown with installation cables in place for installing floor joists thereof.

FIG. 11 is a top plan view of the underpinning system, shown with floor support beams thereof installed.

FIG. 12 is a vertical cross-sectional view taken generally along line 12—12 in FIG. 11.

FIG. 13 is a vertical cross-sectional view taken generally along line 13—13 in FIG. 12.

FIG. 14 is a vertical cross-sectional view taken generally along line 14—14 in FIG. 17.

FIG. 15 is a vertical cross-sectional view of the area generally shown in circle 15 in FIG. 17.

Figure 4:
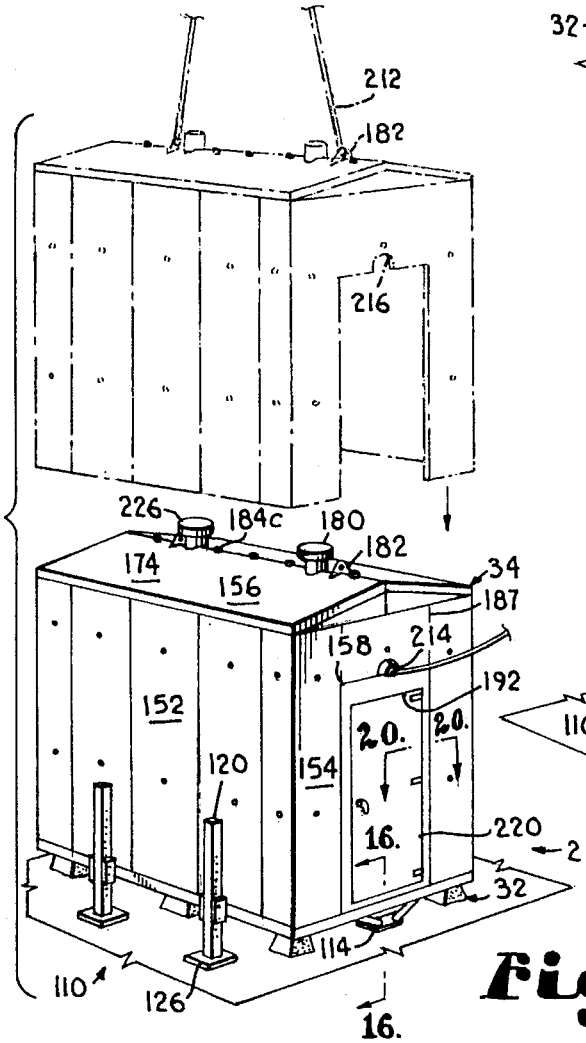
FIG. 4 is an upper perspective view of the encapsulating structure.

FIG. 16 is a vertical cross-sectional view taken generally along line 16—16 in FIG. 4 and particularly showing a seal subassembly of a door assembly.

FIG. 17 is a fragmentary, front elevational view of the underpinning system.

Figure 18:
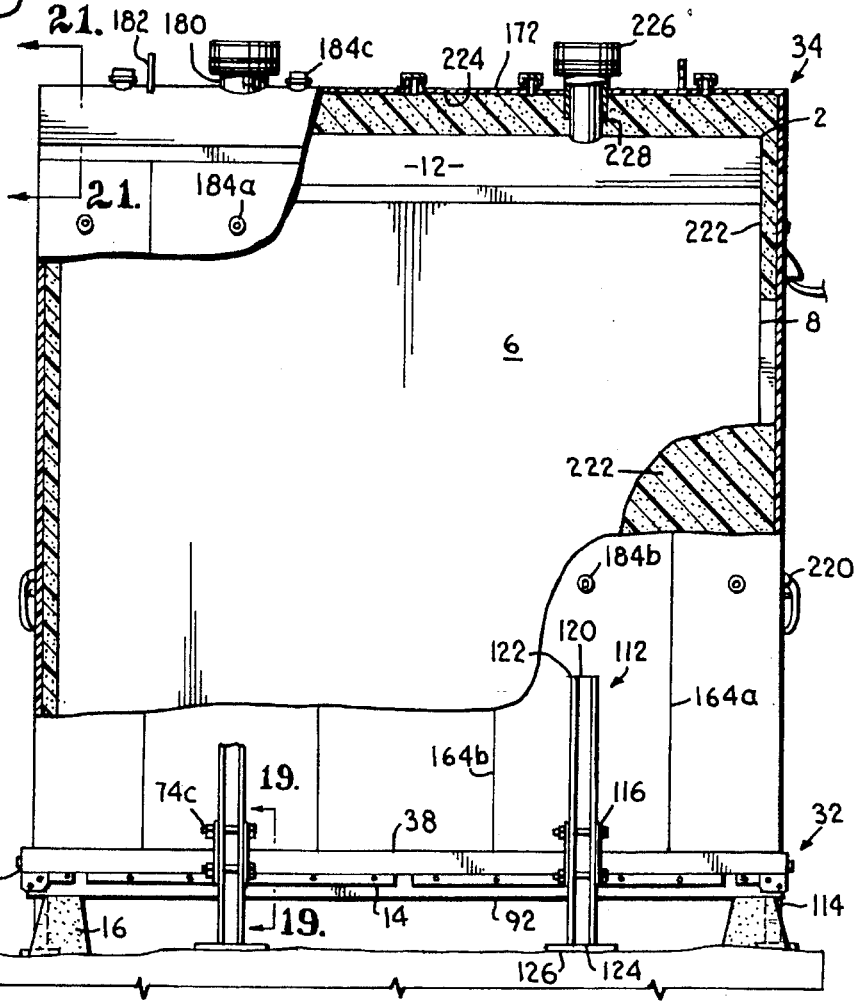

FIG. 18 is a side elevational view of the encapsulating structure with portions broken away to reveal internal construction.

FIG. 19 is a vertical cross-sectional view taken generally along line 19 in FIG. 18.

FIG. 20 is a horizonal cross-sectional view taken generally along line 20—20 in FIG. 4 and particularly showing a jamb subassembly of the door assembly.

Figure 21:
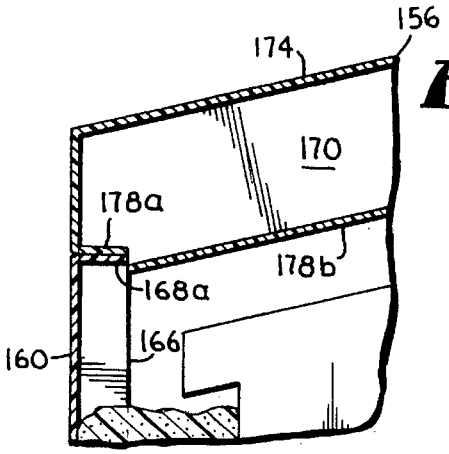

FIG. 21 is a vertical cross-sectional view taken generally along line 21—21 in FIG. 18.

Figure 22:
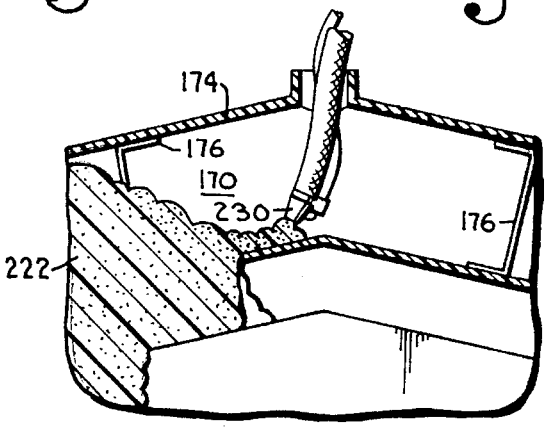

FIG. 22 is a vertical cross-sectional view, particularly showing the injection of foam in an interstitial space between the existing roof and the encapsulating structure roof.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a structure for encapsulating or enclosing an existing building 4. Without limitation on the generality of existing buildings which can be encapsulated or enclosed by the structure 2, a building 4 is shown which is of a type commonly located along railroad rights-of-way for enclosing electrical equipment such as switchgear, communications equipment, power distribution equipment and the like.

The existing building 4 includes opposite side walls 6, opposite end walls 8 and a roof 12 (FIG. 4). One or both of the end walls 8 can include a door opening 10 mounting a door 11. The existing doors 11 can be removed from the existing door openings 10 prior to encapsulation.

The existing building 4 is supported on a pair of existing floor support or channel members 14 each resting on and supported by a plurality (e.g., three on each side are shown) of concrete foundation piers 16. An existing floor structure 18 rests on and is supported by the channel members 14, each of which includes an outwardly-open channel 15. The existing floor structure 18 includes an existing floor deck 20 and a plurality of transversely-extending floor flanges 22 (FIG. 5).

Figure 1:
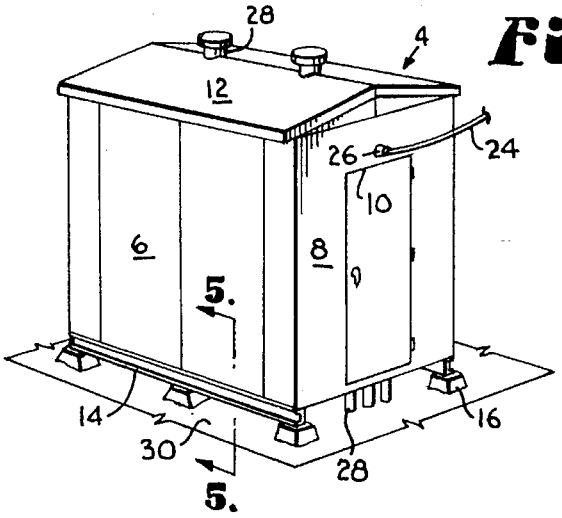
FIG. 1 is an upper perspective view of an existing building of the type which can be encapsulated by the structure and method of the present invention.
Figure 2:
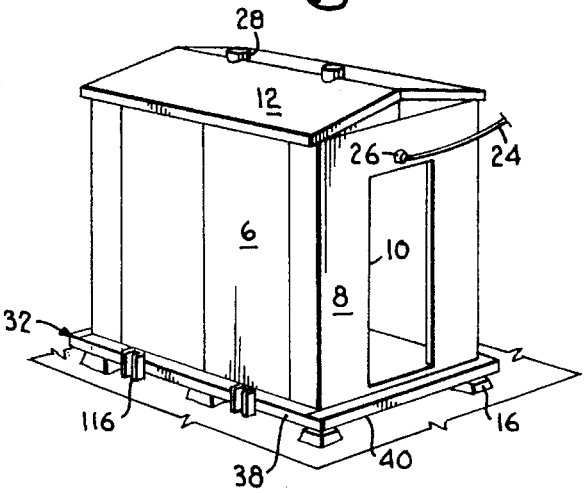
FIG. 2 is an upper perspective view of the existing building, shown with portions of an underpinning system of the encapsulating structure installed.

Electrical service lines 24 enter the existing building 4 by way of a masthead 26. Buried service lines enter the existing building 4 through riser conduits 28 (FIG. 1).

The structure 2 generally comprises an underpinning system or means 32 and a shell system or means 34.

II. Underpinning System or Means 32

The underpinning system or means 32 includes a perimeter frame assembly 36 which includes a pair of frame side rails 38 and a pair of frame end rails 40 interconnected at respective corners 42 whereby the frame assembly 36 has a generally rectangular configuration (FIG. 10*a*).

Each frame side rail 38 has outer and inner, generally vertical main flanges 44*a*, 44*b* which are interconnected along their upper edges by a generally horizontal main web 46. Each frame side rail 38 also includes an inner, generally vertical mounting member flange 48 connected to a lower edge of the inner main flange 44*b* by a mounting member web 50. The main flanges 44*a*, 44*b* and the main web 46 collectively form a frame side rail channel member 52. The inner, mounting member flange 48 and the mounting member web 50 collectively form an angle-section mounting member 54 (FIG. 8).

Each frame side rail 38 includes opposite ends 56 each mounting at a right angle a respective coupler 58 with the general configuration of a downwardly-open channel. At each side rail end 56, the inner main flange 44*b*, the mounting member flange 48 and the mounting member web 50 are recessed to receive a respective coupler 58 (FIG. 6).

Each side rail main web 46 includes a plurality of longitudinally-spaced, elongated, transversely-oriented, slotted receivers 60. Each mounting member flange 48 includes a plurality of longitudinally-spaced receivers 62. Each coupler 58 includes a plurality of longitudinally-spaced receivers 64, which can be slotted, in upper and outer legs thereof (FIG. 6).

Each end rail 40 includes outer and inner end rail flanges 66*a*, 66*b* and upper and lower end rail webs 68*a*, 68*b*. The end rail upper web 68*a* connects the end rail flanges 66*a*, 66*b* along their upper edges and the end rail lower web 68*b* projects generally horizontally inwardly from a lower edge of the end rail inner flange 66*b* (FIG. 13).

Each end rail 40 includes opposite ends 70 whereat the end rail inner flange 66*b* and the end rail webs 68*a*, 68*b* are recessed to receive a respective side rail end 56, with a respective coupler 58 being positioned between the end rail flanges 66*a*, 66*b* and below the end rail upper web 68*a*. Each end rail upper web 68*a* includes a plurality of receivers 72, which can be slotted (FIG. 6). Each end rail outer flange 66*a* also includes a plurality of elongated, longitudinally-oriented, slotted receivers 73 adapted for adjustable alignment with respective coupler receivers 64. The end rail upper web receivers 72 in proximity to the end rail ends 70 are also adapted for adjustable alignment with respective coupler receivers 64. Each end rail end 70 receives a respective coupler 58 and is adjustably secured thereto by mechanical fasteners 74*a* extending through aligned coupler receivers 64 and end rail receivers 72, 73 (FIGS. 6 and 17). The mechanical fasteners 74*a* can comprise bolts 76, nuts 78 and washers 80 (FIG. 9). Alternatively, other types of mechanical fasteners could be employed, such as rivets, or the couplers 58 could be welded to the side rail ends 70 for a more permanent connection.

Each end rail 40 includes two pairs of floor support beam brackets 82 fastened (e.g., by welding) to its underside. The beam brackets 82 have generally L-shaped configurations for fixed engagement with the end rail flanges 66*a*, 66*b* and the end rail webs 68*a*, 68*b*. The beam bracket pairs are mounted on each end rail 40 in spaced relation inwardly from respective ends 70 thereof (FIGS. 12 and 13). Each end rail 40 includes an angle-section stiffener 84 fastened (e.g., by welding) to and extending between respective inner beam brackets 82. Each stiffener 84 includes a plurality of transversely-spaced receivers 86 in a vertical leg 88 thereof, which align with corresponding receivers 90 in a respective side rail outer flange 66*a* (FIGS. 12, 14 and 17).

A pair of floor support beams 92 extend longitudinally between respective opposed pairs of beam brackets 82 (FIG. 11), and each has the general configuration of a box beam and can be formed by closing off the channel of a channel section 92 with a plate 96 (FIG. 12) or with a second, smaller channel section.

Each floor support beam 92 includes opposite ends 98 with receivers 100 for receiving mechanical fasteners 74*b* which extend through the receivers 100 and through corresponding receivers 83 in the beam brackets 82. The beam bracket receivers 83 comprise vertically-oriented slots for vertically, adjustably mounting the floor support beam ends 98 (FIG. 13).

A plurality of channel-section floor joists 102 are placed on the floor support beams 92 and extend transversely with respect thereto (FIG. 11). Each floor joist 102 includes opposite ends 104 which terminate in spaced relation inwardly from respective frame side rails 38. The floor joists 102 are downwardly-open when placed on the floor support beams 92. Strips 106 comprising a resilient material, such as rubber, are placed on top of the floor joists 102 and engage the underside of the existing floor deck 20 (FIG. 14).

Figure 3:
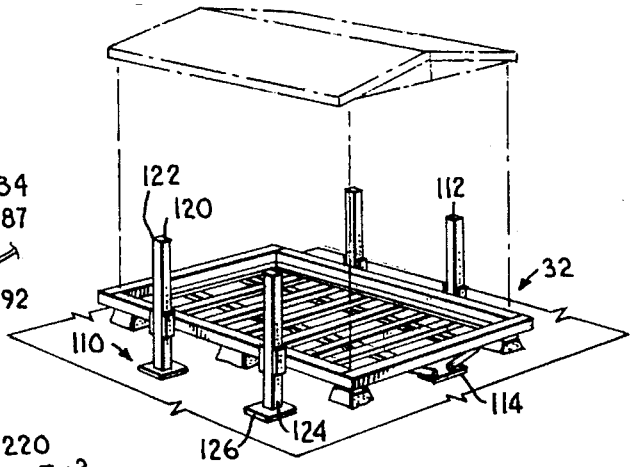
FIG. 3 is an upper perspective view, particularly showing the underpinning system of the encapsulating structure embodying the present invention.

The underpinning system or means 32 includes a foundation subsystem or means 110, which generally comprises two pairs of outrigger assemblies 112, each pair being mounted on a respective frame side rail 38, and a pair of scissor jack assemblies 114 each mounted on a respective frame end rail 40 (FIG. 3).

Each outrigger assembly 112 includes an outrigger mounting channel 116 with horizontally-opposed pairs of receivers 118. A pair of mounting channels 116 are affixed (e.g., by welding) to each side rail outer main flange 44*a* in spaced relation inwardly from a respective side rail end 56. Each outrigger assembly 112 includes a channel section outrigger leg 120 with an upper end 122 adapted for protruding above a respective mounting channel 116 and a lower end 124 mounting a base plate 126. Each outrigger leg 120 includes a plurality of opposed pairs of receivers 128 in spaced relation along both sides thereof in horizontally aligned pairs. The outrigger legs 120 are height-adjustably mounted on respective mounting channels 116 by means of mechanical fasteners 74*c*. Two pairs of gussets 117 are mounted in each side rail 38 with each pair being adjacent to a respective outrigger mounting channel 116 (FIGS. 15 and 17).

Each scissor jack assembly 114 (FIGS. 14 and 17) includes a pair of scissor jack legs 130 which are adjustably splayed with respect to each other to form an adjustable, included angle therebetween. Each scissor jack leg 130 includes upper and lower ends 132, 134. Each scissor jack assembly 114 includes a base channel 136 affixed (e.g, by welding) in an upwardly-open orientation on a respective scissor jack assembly base plate 138. Each scissor jack leg 130 is mounted at its upper and lower ends 132, 134 to the frame end rail 40 and the base channel 136 respectively by mechanical fasteners 74*d*. The upper mechanical fasteners 74*d* extend through respective, aligned receivers 86, 90 and the leg upper ends 132.

The height of each outrigger assembly 112 is adjustable by utilizing different receivers 128 and the heights of the scissor jack assemblies 114 are adjustable by utilizing different pairs of receivers 86, 90.

III. Shell System or Means 34

The shell system or means 34 generally includes opposite side walls 152, opposite end walls 154, a roof 156, an open bottom 210 and a pair of door assemblies 158. Each door assembly 158 is located in a respective end wall 154.

The walls 152, 154 generally comprise wall panels 160 with outer wall skins 162 and first and second edges 164*a*, 164*b* which are formed for interconnection of adjacent panels 160 and which provide rigidity for the wail panels 160 by forming wall studs 166. Each wall panel 160 also includes upper and lower flanges 168*a*, 168*b* which project inwardly from respective wall panel skim 162. Each wall panel lower flange 168*b* includes a plurality of slotted receivers 169 which align with respective side rail main web and end rail upper web receivers 60, 72 for receiving mechanical fasteners 74*e* whereby the wall panels 160 are mounted on the side and end rails 38, 40. The wall panel lower flanges 168*b* can be notched to clear the coupler-to-end rail mechanical fasteners 74*a* adjacent to the frame assembly comers 42. The mechanical fasteners 74*e* can comprise bolt, nut and washer combinations with the nuts welded onto the bolts for relatively permanent mounting.

The roof 156 includes roof rafters 170 which slope outwardly and downwardly from a ridge line 172, a roof skin 174 and purlins 176 which extend generally horizontally and longitudinally between respective adjacent pairs of rafters 170. The roof 156 includes side and end flanges 178*a*, 178*b* for attachment to the wall upper flanges 168*a*. The roof 156 also includes a plurality of vents 180 and a pair of lifting lugs 182, all of which project upwardly from the ridge line 172.

The wall panels 160 include upper and lower sets of foam inlet or injection ports 184*a*, 184*b* and the roof 156 includes a plurality of foam injection ports 184*c*. Pipe nipples with diameters of, for example, 3", can be used for the roof foam injection ports 184*c*.

Each end wall 154 includes a door opening 185 and a transom panel 187 located thereover. Each door assembly 158 includes a respective door frame 186 with respective sill, jamb and head subassemblies 188, 190, 192. The sill subassembly 188 (FIG. 16) includes an angle-section spacer 194 with a vertical leg 196 adapted for engaging the existing floor structure 18 and a horizontal leg with slotted receivers 200 adapted for receiving end rail-to-sill subassembly mechanical fasteners 74*f*. The sill subassembly 188 also includes an angle-section transition member 202 mounted on a respective end rail upper web 68 and in turn mounting a respective sill threshold 204 by means of a plurality of transition member-to-threshold mechanical fasteners 74*g*. The sill threshold 204 includes an outwardly open sill channel 206.

Each jamb and head subassembly 190, 192 includes an angle-section jamb/head spacer 208 mounted on an existing end wall 8 by spacer-to-end wall mechanical fasteners 74*h*. The spacers 208 project outwardly from the existing end walls 8 for adjustable connection to respective wall panels 160 (FIG. 20). Each spacer 208 is adjustably mounted on a respective wall panel 160 by spacer-to-wall panel mechanical fasteners 74*i* received in slotted receivers 209. Jamb/head sealing strips 218 are mounted on the jamb/head spacers 208 by spacer-to-sealing strip mechanical fasteners 74*j*.

The head frame subassembly 192 includes an electrical line inlet 214 aligned with a respective notch 216 in a respective transom panel 187. Each door frame 186 hingedly receives a respective door 220 for selectively closing the door opening 185. The door opening 185 is shown centered in a respective shell end wall 154, but could be located off-center to align with a respective existing door opening 10.

Insulation means 222, for example, expanded polyurethane foam, is injected through respective foam inlet or injection ports 184*a*, 184*b*, 184*c* into interstitial spaces 224 between the existing building 4 and the shell system 34. The insulation foam 222 serves to insulate the interior of the existing building 4 and can provide a measure of protection for it against further deterioration from rust, corrosion and the like. Still further, the insulation foam 222 can bond the existing walls 6, 8 and the existing roof 12 to the shell system 34 whereby the resulting, encapsulated building can achieve greater strength and structural rigidity than would be achieved if the existing building 4 and the shell system 34 were not connected in this manner.

IV. Encapsulating Method and Operation of the Structure 2

The structure 2 can be sized to fit relatively standard (e.g., 6' wide×8' long) existing buildings. By providing slotted receivers at many of the connections, relatively fine adjustments can be made in the configuration and dimensions of the underpinning system and the shell system to accommodate slight variations in the configurations and dimensions of existing buildings to be encapsulated. The encapsulating structure 10 could be custom fabricated to accommodate particular existing buildings. Furthermore, certain components are usable with various sizes and configurations of existing buildings. Economy in construction is accomplished by providing a certain degree of modularity for the components of the encapsulating structure 2.

Installation in situ can begin by mounting the side rails 38. The receivers 17 can be cut in the existing channel members 14 with a cutting torch as shown in FIG. 6, or the existing channel members 14 can be drilled to provide the necessary receivers 17 for alignment with the inner mounting member flange receiver 62. The side rails 38 are then bolted to the existing channel members 14 by suitable mechanical fasteners 74*k*.

The floor joists 102 receive the resilient strips 106 placed thereon and are raised into place between the existing floor structure flanges 22 by a pair of cables 107 which extend between the end rails 40 and are tightened by cable retraction devices 108. With the floor joists 102 in place, the floor support beams 92 are then lifted into supporting engagement thereunder and bolted at their ends 98 to respective pairs of beam brackets 82. The cables 107 and the cable retraction devices 108 can then be removed.

The outrigger legs 20 can then be mounted on the side rails 38 with the mechanical fasteners 74*c* extending through the outrigger legs 20 and respective mounting channels 116. The outrigger base plates 126 preferably engage a ground surface 30 below the structure 2, and can be extended into excavations in the ground if necessary to reach soil with a sufficient bearing capacity or to reach soil located below the frost line. With the side rails 38 mounted on the existing channel members 14, the end rails 40 can be installed by placing the couplers 58 in respective end rail ends 70 and securing them in place with the mechanical fasteners 74*a*. The slotted receivers 72 in the end rail ends 70 permit adjustments to the overall width of the perimeter frame assembly 36 to accommodate different spacings of the existing channel members 14.

The scissor jack assemblies 114 may or may not be required, depending upon the condition of the existing building 4, the clear span of the end rails 40, etc. The scissor jack assemblies 114 are installed by placing mechanical fasteners 74*d* in corresponding, aligned receivers 86, 90 with the base plate 126 engaging the ground surface 30.

With the frame assembly 36 and the foundation subsystem 110 in place (FIG. 3), the shell system 34 can be installed. The shell system 34 includes an open bottom 210 which receives the existing building 4 as the shell system 34 is lowered in place by a suitable crane (not shown) connected by lifting lines 212 connected to the lifting lugs 182. The shell system 34 is connected to the underpinning system 32 by mechanical fasteners 74*e* which connect the lower wall panel flanges 168*b* to the side and end rails 38, 40.

The receivers for the mechanical fasteners 74*e* can be slotted to permit adjustable positioning the wall panels 60 on the side and end rails 38, 40.

The seal, jamb and head sub assemblies 188, 190 and 192 of the door frame 186 are adapted for adjustable mounting with the spacers 194, 208 thereof being adapted to adjustably extend between the door opening 185 and an existing end wall 8. One or both of the end walls 154 can receive door assemblies 158. The transom notch 216 and the electrical line inlet 214 receive the electrical line 24.

Insulating foam 222, which can comprise, for example, polyurethane, is injected into the interstitial space between the existing building 4 and the shell system 34 by means of suitable equipment, which can include a nozzle 230 as shown in FIG. 22. The nozzle 230 is inserted through the foam inlet ports 184*a*, 184*b*, 184*c* in the walls 52, 54 and the roof 56. Alternatively, other types of insulating material could be placed between the existing building 4 and the shell system 34.

The doors 220 are hingedly installed on the door frames 186. Vent caps 226 can be placed on top of the vents 180, which are sized to telescopically receive the existing vents 228 (FIG. 18). It will be appreciated that the various receivers in the structure 2 and in the existing building 4 can be slotted or otherwise enlarged to permit adjustments in the mechanical fastening of the various components. Standard size components for the structure 2 can thus be utilized to accommodate the existing buildings 4 which vary somewhat in size and configuration. The materials for encapsulating structure 2 can be chosen for their suitable characteristics, such as weather resistance (e.g. stainless steel, painted steel or aluminum), strength, availability and cost.

It is to be understood that while certain forms of the present invention have been illustrated and described herein, it is not to be limited to the specific forms or arrangement of parts described and shown.

What is claimed and desired to be secured by Letters Patent is as follows:

1. A method of encapsulating an existing building, which comprises the steps of:

(a) providing an underpinning system;

(b) fastening the underpinning system to the existing building;

(c) providing a shell system with opposite side walls, opposite end walls, a roof and an open bottom;

(d) placing said shell system in covering relation over and in spaced relation from said existing building to form an interstitial space between said shell system and said building; and (e) attaching said shell system to said underpinning system.

2. The method according to claim 1, which includes the additional steps of:

(a) lifting said shell system over said existing building;

(b) lowering said shell system onto said underpinning system; and (c) receiving said existing building through said shell system open bottom.

3. The method according to claim 1 wherein said existing building includes a pair of opposite side walls and a pair of existing floor support members each located adjacent to a respective existing building side wall and said method includes the additional step of:

(a) fastening said underpinning system to said existing floor support members.

4. The method according to claim 3 wherein each said existing floor support member comprises a channel section and said method includes the additional steps of:

(a) forming receivers in said existing floor support member channel sections;

(b) providing said underpinning system with a pair of side rails and providing each said side rail with a plurality of receivers;

(c) aligning respective existing floor support member receivers with respective side rail receivers; and (d) bolting each said side rail to a respective existing floor support member by inserting mechanical fasteners through aligned pairs of receivers.

5. The method according to claim 4, which includes the additional steps of:

(a) providing said underpinning system with a perimeter frame assembly including said pair of opposite side rails and a pair of opposite end rails; and (b) connecting said side and end rails together at respective perimeter frame corners.

6. The method according to claim 5, which includes the additional steps of:

(a) providing each said side rail with a pair of couplers extending at substantially right angles from the ends thereof; and (b) telescopically receiving each said coupler in a respective end rail end.

7. The method according to claim 6, which includes the additional steps of:

(a) providing mechanical fasteners for interconnecting said couplers and said end rail ends;

(b) providing elongated receivers in one of said coupler and said end rail end at each said perimeter frame corner; and (c) longitudinally slidably adjusting the position of each said end rail end with respect to a respective coupler fastened thereto.

8. The method according to claim 5, which includes the additional steps of:

(a) providing said underpinning system with a floor support beam; and (b) fastening said floor support beam to said end rails in generally parallel, spaced relation with respect to said side rails.

9. The method according to claim 8, which includes the additional steps of:

(a) providing a plurality of floor joists;

(b) placing said floor joists on said floor support beam; and (c) engaging said floor joists with said existing building.

10. The method according to claim 9, which includes the additional step of:

(a) placing a plurality of resilient strips on top of each said floor joist in engagement with the existing building.

11. The method according to claim 9, which includes the additional steps of:

(a) extending a line between said end rails under said floor joists;

(b) tightening said line;

(c) raising said floor joists into position;

(d) installing said floor support beam; and (e) removing said line.

12. The method according to claim 11, which includes the additional step of:

(a) applying tension to said line with a cable retraction device.

13. The method according to claim 5, which includes the additional step of:

(a) providing said underpinning system with a foundation subsystem for supporting said underpinning system on a ground surface below said existing building.

14. The method according to claim 13, which includes the additional steps of:

(a) providing said foundation subsystem with two pairs of outrigger assemblies;

(b) mounting each pair of outrigger assemblies on a respective side rail;

(c) vertically adjusting the position of each said outrigger assembly; and (d) engaging each said outrigger assembly with the ground surface.

15. The method according to claim 13, which includes the additional steps of:

(a) providing said foundation subsystem with a pair of scissor jack assemblies;

(b) mounting each said scissor jack assembly on a respective end rail; and (c) adjusting the height of said scissor jack assemblies to engage the ground surface.

16. The method according to claim 1, which includes the additional step of:

(a) placing insulating material between said existing building and said shell system.

17. The method according to claim 16, which includes the additional steps of:

(a) providing foam for said insulating material;

(b) providing foam inlet ports in said shell system walls and said shell system roof; and (c) injecting said foam through said inlet ports.

18. The method according to claim 17, which includes the additional steps of:

(a) providing said shell system walls with a plurality of wall panels; and (b) providing each said wall panel with upper and lower sets of foam inlet ports.

19. The method according to claim 1, which includes the additional step of:

(a) providing one of said shell system end walls with a door opening;

(b) providing a door frame assembly;

(c) mounting said door frame assembly in said door opening; and (d) mounting a door on said door frame assembly.

20. The method according to claim 19 wherein said existing building includes an existing door in an existing door opening and said method includes the additional steps of:

(a) removing said existing door from the door opening in the existing building; and (b) aligning the shell system door opening with the existing door opening.

21. The method according to claim 2, which includes the additional steps of:

(a) providing said shell system with lifting lugs on the roof thereof;

(b) attaching lifting lines to said lifting lugs; and (c) lifting said shell system with a crane attached to said lifting lines.

22. A method of encapsulating an existing building having a pair of existing floor support members, an existing floor structure mounted on the existing floor support members, a pair of existing side walls, a pair of existing end walls one of which has an existing door opening, and an existing roof mounted on the existing walls, which method comprises the steps of:

(a) providing an underpinning system with a perimeter frame assembly comprising a pair of side rails and a pair of end rails;

(b) slidably adjustably connecting side rails at respective ends thereof at respective corners of said perimeter frame assembly;

(c) forming corresponding pairs of receivers in said side rails and in said existing floor support members;

(d) aligning said side rail and floor support member receivers;

(e) attaching said side rails to said existing floor support members with mechanical fasteners received in corresponding pairs of receivers;

(f) providing couplers extending at substantially right angles from opposite ends of said side rails;

(g) slidably adjustably mounting each said coupler to a respective end rail end with mechanical fasteners received in slotted receivers;

(h) providing a pair of outrigger assemblies each having an outrigger mounting channel and an outrigger leg;

(i) mounting each said outrigger channel on a respective side rail;

(j) vertically adjustably mounting each said outrigger leg on a respective outrigger mounting channel;

(k) engaging each said outrigger leg with a ground surface below the existing building;

(l) providing a pair of scissor jack assemblies;

(m) mounting each said scissor jack assembly on a respective end rail;

(n) vertically adjusting the height of each said scissor jack assembly and engaging same with the ground surface;

(o) providing a shell system with opposite side walls, opposite end walls, a shell door opening in one of the end walls and a roof mounted on the walls;

(p) prefabricating the shell system at a location remote from the existing building;

(q) lowering the shell system over the existing building;

(r) receiving an existing electrical line to said existing building in a notch in said shell door opening;

(s) receiving existing vent pipes in vent pipes located in said shell system roof;

(t) capping each said vent pipe;

(u) forming an interstitial space between said existing building and said shell structure;

(v) injecting foam through foam inlet ports in said side walls, end walls and roof of said shell system into said interstitial space;

(w) generally aligning said shell door opening with said existing door opening;

(x) removing a door from said existing door opening; and (y) installing a door on said shell opening.

23. A method of encapsulating an existing building, which comprises the steps of:

(a) providing an underpinning system;

(b) fastening the underpinning system to the existing building;

(c) providing a shell system having opposite side walls, opposite end walls, a roof and an open bottom;

(d) lifting the shell system over the existing building;

(e) lowering the shell system onto the underpinning system;

(f) receiving the existing building through the open bottom of the shell system; and (g) attaching the shell system to the underpinning system.

24. A method of encapsulating an existing building, which comprises the steps of:

(a) providing an underpinning system with a perimeter frame assembly, the assembly including a pair of opposite side rails and a pair of opposite end rails, the side and end rails being connected at respective perimeter frame corners;

(b) fastening the underpinning system to the existing building;

(c) providing a shell system with opposite side walls, opposite end walls, a roof and an open bottom;

(d) placing the shell system in covering relation over the existing building; and (e) attaching the shell system to the underpinning system.

25. A method of encapsulating an existing building, which comprises the steps of:

(a) providing an underpinning system;

(b) fastening the underpinning system to the existing building;

(c) providing a shell system with opposite side walls, opposite end walls, a roof and an open bottom;

(d) providing inlet ports in the side walls, end walls and roof of the shell system;

(e) placing the shell system in covering relation over the existing building;

(f) attaching the shell system to the underpinning system;

(g) providing insulating material; and (h) injecting the insulating material through the inlet ports.

* * * * *